US005769245A

United States Patent [19]

Butler

[11] Patent Number: 5,769,245

[45] Date of Patent: Jun. 23, 1998

[54] TOOTHBRUSH HOLDER

[76] Inventor: Stevan Ray Butler, 22809 121st St. SE., Monroe, Wash. 98272

[21] Appl. No.: 845,188

[22] Filed: Apr. 21, 1997

[51] Int. Cl.[6] ..... A47F 7/00

[52] U.S. Cl. ..... 211/65; 211/70; D6/534; 248/110

[58] Field of Search ..... 211/65, 66, 70, 211/163; D6/534; 248/110

[56] References Cited

U.S. PATENT DOCUMENTS

| | | | |
|---|---|---|---|
| D. 241,200 | 8/1976 | Halsted et al. | D6/534 |
| D. 278,778 | 5/1985 | Brown | D6/534 |
| D. 323,090 | 1/1992 | Santavelli et al. | D6/534 |
| 1,975,691 | 10/1934 | Hibbs | 211/65 |
| 2,038,941 | 4/1936 | Koch | 211/65 X |
| 2,117,459 | 5/1938 | Stanton | 211/65 |
| 2,956,851 | 10/1960 | Merendino | D6/534 X |

*Primary Examiner*—Robert W. Gibson, Jr.
*Attorney, Agent, or Firm*—David L. Volk

[57] ABSTRACT

A base includes a central member adapted to rest on a flat horizontal surface. A distal handle end support member for supporting a distal handle end of a toothbrush is configured to rotate relative to the central member. An elongated member extends outward from the distal handle end support member and is fixedly connected to the distal handle end support member. A dome is connected to a distal end of the elongated member and has a completely uncovered open mouth facing the base. A resting member is positioned annularly about the elongated member for leaning the toothbrush there-against near a head of the toothbrush when the distal handle end is supported on the distal handle end support member. The dome is positioned to cover the head of the toothbrush when the distal handle end is supported on the distal handle end support member and the toothbrush is leaning against the resting member. In another embodiment, the toothbrush holder is configured to hang on a wall.

7 Claims, 4 Drawing Sheets

TOOTHBRUSH HOLDER

BACKGROUND OF THE INVENTION

1. Field of the Invention

The present invention relates to holders, particularly to a toothbrush holder.

2. Description of the Related Art

Conventional toothbrush holders leave the bristles of the toothbrush unprotected, where they can become contaminated with hair spray, anti-perspirants, air fresheners, surface cleaners, splashed soap and water, and other common bathroom contaminants.

Attempts have been made in the prior art to solve this problem. U.S. Pat. No. D323,190 to Santarelli et al. discloses an ornamental design for a toothbrush holder which completely encloses the entire toothbrush. Although Santarelli et al. may protect the toothbrush from contaminants, the holder would hinder drying out of the bristles because it completely encloses the toothbrush.

U.S. Pat. No. D278,778 to Brown discloses an ornamental design for a toothbrush holder which protects the bristles from contaminants, by utilizing a dome adapted to cover the tops of the toothbrushes, including the bristles. The dome is connected to a toothbrush support plate having apertures there-through to support toothbrushes in a hanging manner from their heads. This method of securing the toothbrush within the holder limits the size, style and shape of toothbrushes that can be used with the holder. Because the only openings into the dome are the apertures in the support plate, air circulation about the bristles is limited, thus hindering drying of the bristles.

What is needed is a toothbrush holder which protects the bristles of the toothbrush from contaminants, does not hinder drying of the bristles, and which can be used with toothbrushes in a variety of sizes, styles and shapes.

SUMMARY OF THE INVENTION

The toothbrush holder of the present invention includes a base having a central member. The central member is adapted to rest on a flat horizontal surface. A distal handle end support member for supporting a distal handle end of a toothbrush is configured to rotate relative to the central member. An elongated member extends outward from the distal handle end support member and is fixedly connected to the distal handle end support member. A dome is connected to a distal end of the elongated member. An open mouth of the dome is completely uncovered and faces the base. A resting member is positioned annularly about the elongated member for leaning the toothbrush there-against near a head of the toothbrush when the distal handle end is supported on the distal handle end support member. The dome is positioned to cover the head of the toothbrush when the distal handle end is supported on the distal handle end support member and the toothbrush is leaning against the resting member.

Because the dome covers the head of the toothbrush, the bristles are protected from contaminants. Because an open mouth of the dome is completely uncovered, the holder does not hinder drying of the bristles. Because the toothbrush is supported by a distal handle end support member and a resting member, instead of by hanging the toothbrush from the bristles or the head, drying of the bottom of the bristles is unhindered and the holder can be used with toothbrushes in a variety of sizes, styles and shapes.

Still further features and advantages will become apparent from the ensuing description and drawings.

DETAILED DESCRIPTION

Figure 1:
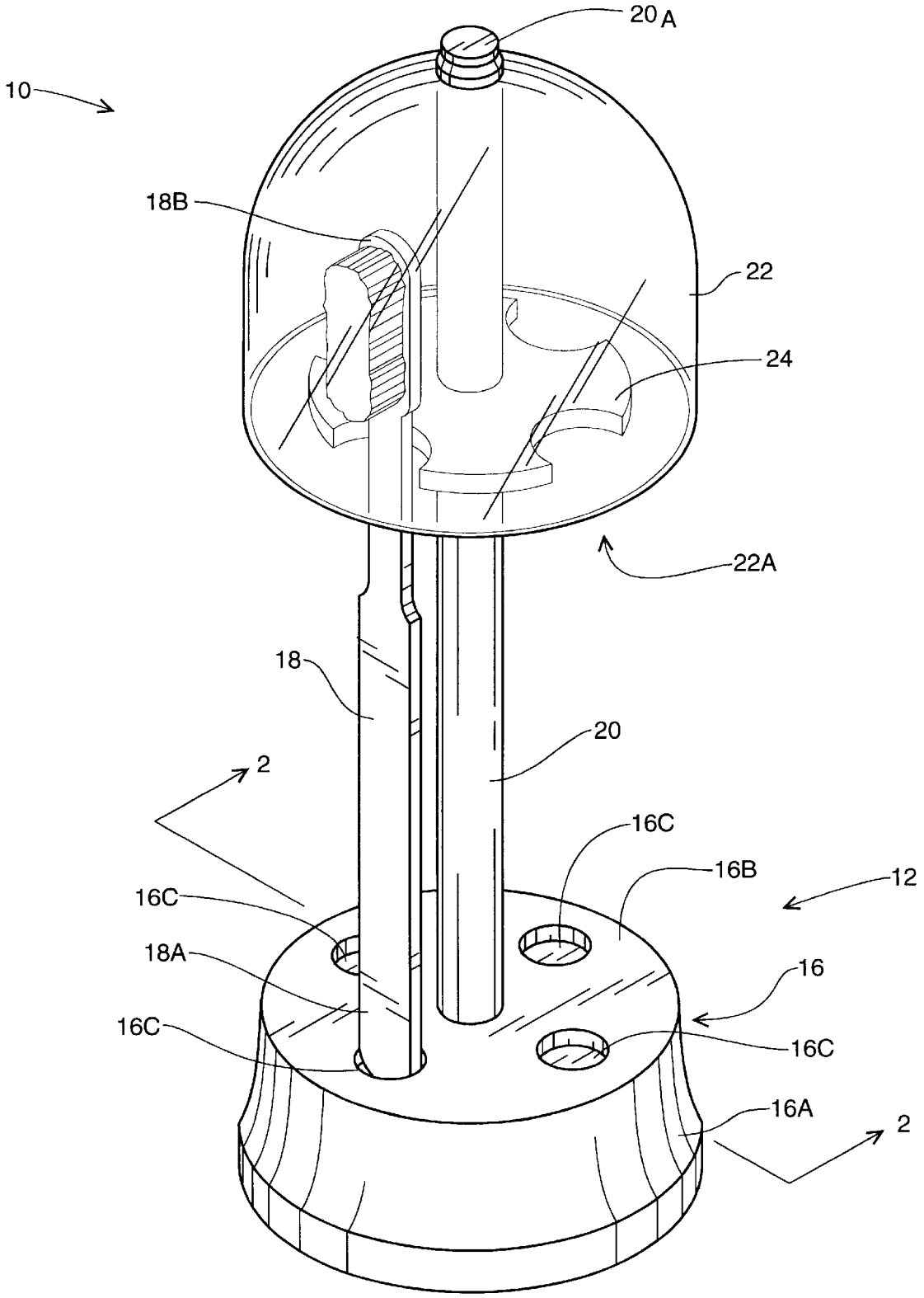
FIG. 1 is a perspective view of a toothbrush holder.
Figure 2:
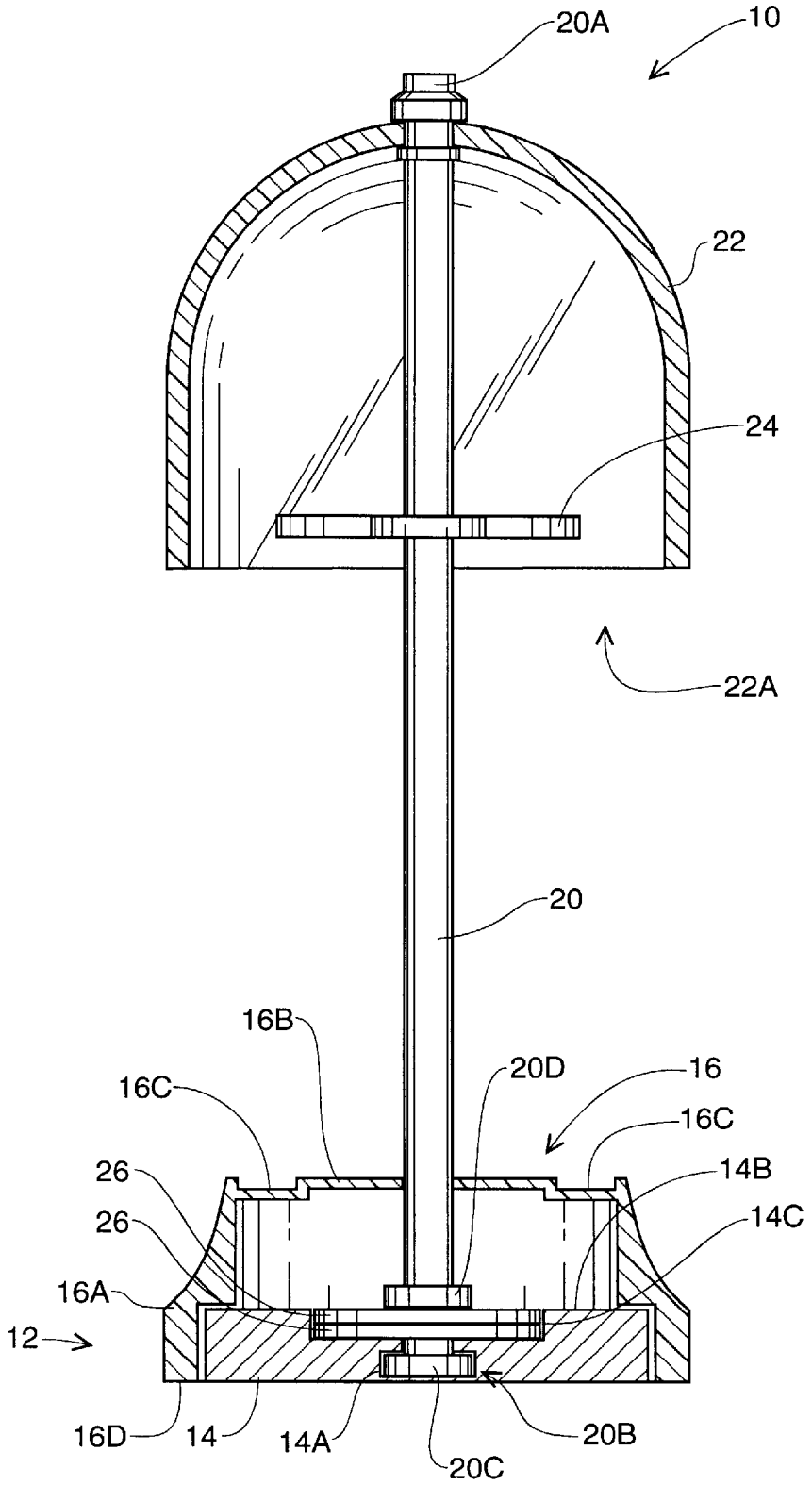
FIG. 2 is a cross-section of the toothbrush holder taken along line 2—2 of FIG. 1.

FIG. 1 is a perspective view of a toothbrush holder 10 of the present invention. FIG. 2 is a cross-sectional view of the toothbrush holder 10 taken along line 2—2 of FIG. 1. Referring to FIGS. 1 and 2, the toothbrush holder 10 includes a base 12 which includes a substantially disc-shaped central member 14 adapted to rest on a flat horizontal surface (not shown), such as a sink or counter top. A distal handle end support member 16 for supporting a distal handle end 18A of a toothbrush 18 is configured to rotate relative to the central member 14. An elongated member 20 extends outward from the distal handle end support member 16 and is fixedly connected to the distal handle end support member 16. A dome 22 is connected to a distal end 20A of the elongated member 20 and has an open mouth 22A which is completely uncovered and faces the base 12. A resting member 24 is positioned annularly about the elongated member 20 for leaning the toothbrush 18 there-against near a head 18B of the toothbrush 18 when the distal handle end 18A is supported on the distal handle end support member 16. The dome 22 is positioned to cover the head 18B of the toothbrush 18 when the distal handle end 18A is supported on the distal handle end support member 16 and the toothbrush 18 is leaning against the resting member 24.

The elongated member 20 includes a first ring 20C disposed at a first end 20B of the elongated member 20. The central member 14 includes a cavity 14A capturing the first ring 20C therein such that the ring 20C and the elongated member 20 are free to rotate with respect to the central member 14. The elongated member 20 is substantially perpendicular to a broad face 14B of the central member 14.

A second ring 20D is disposed on the elongated member 20 inboard of the first ring 20C. The first and second rings 20C, 20D are each fixedly connected to the elongated member 20). A pair of washers 26 are disposed rotatably on the elongated member 20 between the first ring: 20C and the second ring 20D. The washers 26 rest within a recess 14C within the broad face 14B of the central member 14, and the second ring 20D rests against the washers 26, when the toothbrush holder 10 is placed upright on a flat surface.

The distal handle end support member 16 comprises a sleeve 16A circumferentially disposed about the central member 14. A substantially planar, circular top member 16B is connected to the elongated member 20 and extends outward to and connects with the sleeve 16A. The top member 16B includes top member depressions 16C therein adapted to support the distal handle end 18A of the toothbrush 18 therein. The sleeve 16A includes a circular rim 16D which is notched to receive the central member 14 therein. Thus, the toothbrush holder 10 of the present invention permits a user (not shown) to rotate a toothbrush 18 into a desired position by rotating the distal handle end support member 16 relative to the central member 14. Other configurations of the base 12 to permit rotation of the toothbrushes 18 into position are within the scope of the present invention. Alternatively, the base 12 may be non-rotatable, with the associated disadvantage of not being able to easily rotate a toothbrush 18 into any desired position.

Figure 3:
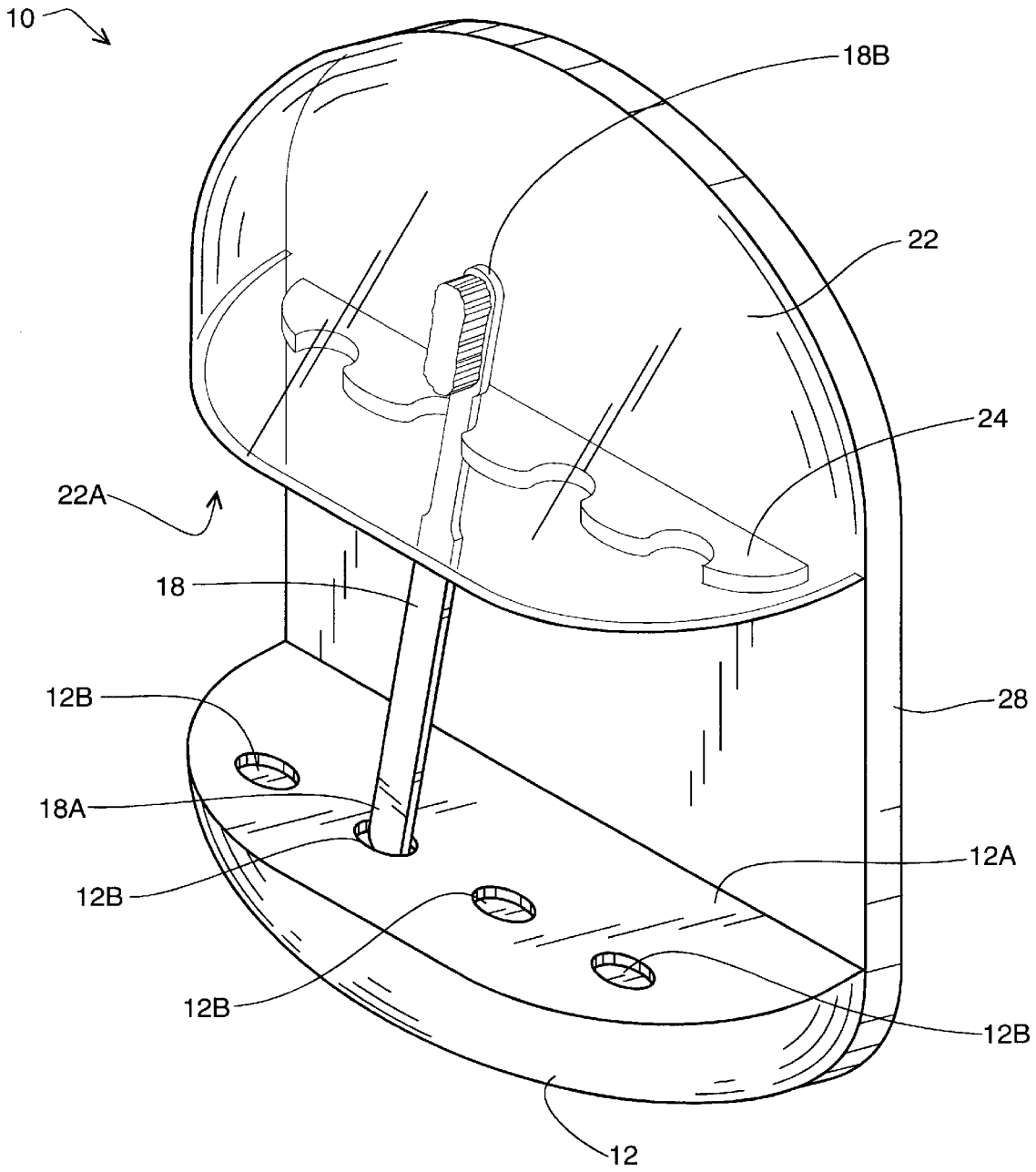
FIG. 3 shows another embodiment of the toothbrush holder.

FIG. 3 shows another embodiment of the toothbrush holder 10, wherein the base 12 includes depressions 12B in a broad surface 12A thereof, for supporting the distal handle end 18A of the toothbrush 18 therein. A plate 28 extends outwardly from the base 12 and includes a dome 22 at a distal end thereof, the dome 22 having an open end 22A facing the base 12. A resting member 24 is attached to the plate 28. The resting member 24 is for leaning the toothbrush 18 there-against near a head 18B of the toothbrush 18 when the distal handle end 18A is supported in the depression 12B. The dome 22 is positioned to cover the head 18B of the toothbrush 18 when the toothbrush 18 is resting against the resting member 24 and the distal handle end 18A is supported in the depression 12B.

Figure 4:
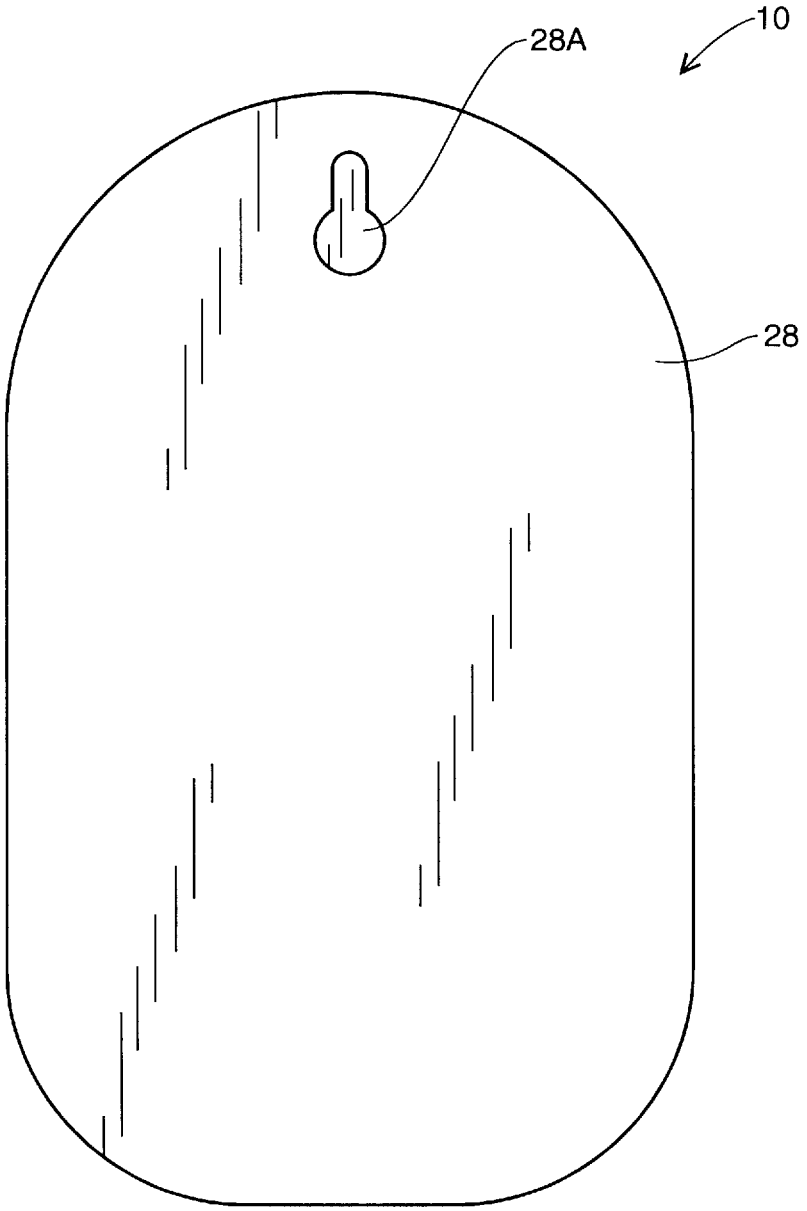
FIG. 4 is a rear elevational view of the embodiment of the toothbrush holder shown in FIG. 3.

FIG. 4 is a rear elevational view of the embodiment of the toothbrush holder 10 shown in FIG. 3. The plate 28 includes a key shaped recess 28A for hanging the toothbrush holder 10 on a wall (not shown). Other means for hanging the toothbrush holder 10 on a wall are within the scope of the present invention.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A toothbrush holder comprising:

a. a base adapted to support a distal handle end of a toothbrush thereon;

b. a resting means for leaning at least one toothbrush there-against near a head of the toothbrush when the distal handle end is supported on the base;

c. a dome adapted to cover a head of the toothbrush when the distal handle end of the toothbrush is supported on the base and the toothbrush is leaning against the resting means; and d. the dome having a completely uncovered open mouth for air to pass through and for the toothbrush to extend through when the dome is covering the head of the toothbrush.

2. A toothbrush holder comprising:

a. a base adapted to support a distal handle end of a toothbrush thereon;

b. an extension extending outwardly from the base;

c. a resting means connected to the extension for leaning at least one toothbrush there-against near a head of the toothbrush when the distal handle end is supported on the base;

d. a dome positioned at a distal end of the extension, the dome adapted to cover a head of the toothbrush when the toothbrush is leaning against the resting means and the distal handle end is supported on the base; and e. the dome having a completely uncovered open mouth for air to pass through and for the toothbrush to extend through when the dome is covering the head of the toothbrush.

3. The toothbrush holder of claim 2, wherein the base is adapted to rest on a flat horizontal surface with the dome positioned above the base, and the extension is an elongated member.

4. The toothbrush holder of claim 3, wherein:

a. the base includes a central member adapted to rest on the flat horizontal surface;

b. the base further includes a distal handle end support means configured to rotate relative to the central member; and c. the distal handle end support means is fixedly connected to the extension and the resting means is fixedly connected to the extension, thus permitting a user of the toothbrush holder to rotate a toothbrush into a desired position by rotating the distal handle end support means relative to the central member.

5. The toothbrush holder of claim 2, wherein the extension is a planar member adapted to be mounted on a wall with the dome positioned above the base.

6. A toothbrush holder comprising:

a. a base including a central member, the central member adapted to rest on a flat horizontal surface;

b. a distal handle end support means for supporting a distal handle end of a toothbrush;

c. the distal handle end support means configured to rotate relative to the central member;

d. an elongated member extending outward from the distal handle end support means and fixedly connected to the distal handle end support means;

e. a dome connected to a distal end of the elongated member and having a completely uncovered open mouth facing the base;

f. a resting means positioned annularly about the elongated member for leaning the toothbrush there-against near a head of the toothbrush when the distal handle end is supported on the distal handle end support means; and g. the dome positioned to cover the head of the toothbrush when the distal handle end is supported on the distal handle end support means and the toothbrush is leaning against the resting means.

7. The toothbrush holder of claim 6, wherein the central member includes a cavity rotatably capturing a first end of the elongated member therein.

* * * * *